United States Patent [19]

Cramblett

[11] Patent Number: 4,643,422

[45] Date of Patent: Feb. 17, 1987

[54] BASKETBALL BACKBOARD ADJUSTER

[76] Inventor: Jon J. Cramblett, 1020 SE. 36th, Troutdale, Oreg. 97060

[21] Appl. No.: 712,272

[22] Filed: Mar. 15, 1985

[51] Int. Cl.[4] ..... A63B 63/08

[52] U.S. Cl. ..... 273/1.5 R; 248/641

[58] Field of Search ..... 273/1.5 R; 248/641

[56] References Cited

U.S. PATENT DOCUMENTS

| | | | |
|---|---|---|---|
| 2,747,819 | 5/1956 | Aldrich et al. | 248/641 |
| 2,916,288 | 12/1959 | Chervenka | 273/1.5 R |
| 2,928,630 | 3/1960 | Wiseman | 248/641 |
| 2,928,631 | 3/1960 | Hartman | 248/641 |
| 2,986,395 | 5/1961 | Sheftel | 273/1.5 R |
| 3,181,849 | 5/1965 | Mitchell | 273/1.5 X |
| 3,964,743 | 6/1976 | Salsich, Sr. | 273/1.5 R |
| 4,377,283 | 3/1983 | Mahoney | 273/1.5 R |
| 4,395,040 | 7/1983 | White | 273/1.5 R |

*Primary Examiner*—Paul E. Shapiro
*Attorney, Agent, or Firm*—Glen A. Collett

[57] ABSTRACT

A basketball backboard adjustment apparatus operable to vary the height of a basketball goal. A mounting standard, such as a post or the like, has a mounting assembly which in other than the present invention would normally mate with a mounting assembly of a basketball backboard. Disposed between these two mountings, the backboard adjuster includes a frame attached to one of the mountings, a track mounted on the frame and extending vertically, a carriage mounted on the track, an attachment assembly on the carriage engageable with the other mounting assembly, and a user controlled adjustment apparatus interconnecting the frame and the carriage for moving the carriage along the track as desired by the user for raising and lowering the basketball goal.

16 Claims, 5 Drawing Figures

BASKETBALL BACKBOARD ADJUSTER

BACKGROUND OF THE INVENTION

This invention relates to basketball playing equipment, and more particularly to an apparatus for adjusting the height of a basketball backboard and hoop.

It is normal practice to mount a basketball hoop at a height of ten feet above the playing surface. This is the standard height set by rules, and so it is uncommon to vary therefrom. However, it has been observed that those learning to play basketball, especially children, benefit by having the hoop at a lower height. It is thus easier to make shots, and this of course builds the confidence of the beginner. Some elementary schools have their baskets mounted at a height of eight feet for this purpose.

Nevertheless, after not many years, the beginner becomes proficient enough to desire to have the basket at the standard ten feet. While this does not pose so big a problem for schools, where children are divided by grades, there are numerous playgrounds, parks and other public basketball facilities where people of all ages play. It is desirable to be able to lower the basket for children, to a height that provides a challange while still building their confidence, yet to raise the basket to the standard height for adult games.

The same is true of home basketball facilities. Children prefer to have the hoop mounted lower, but this is unacceptable for adults playing with the same equipment. Accordingly, an adjustable height backboard and hoop is very desireable.

The prior art includes several and varied systems for mounting a basketball goal adjustably. One device simply provides for clamping the backboard at various heights to a post. Other designs are of a parallelogram configuration. All designs previously known are difficult to adjust, sometimes requireing heavy duty work by more than one adult. In no case known, is a prior art device simple and easy enough that the basketball goal could be adjusted by children desiring a lower basket. Another disadvantage of parallelogram systems is that when the height is adjusted, there is also a change in horizontal distance from a set point on the court. This is not a desirable effect. Rather, the goal should at all times have the proper horizontal relationship to the court, even though the height is varied.

Accordingly, it is the general object of the present invention to provide an apparatus for adjusting the height of a basketball goal, in a simple and easily used manner.

Another object is to provide a device which moves the basket only vertically.

Yet another object is to provide an assembly which accomodates most all common basketball backboard mountings.

A further object is to provide a thin device, which can be incorporated into existing mountings, and still not disrupt the location of the goal.

Yet another object is to provide a safe and strong apparatus.

A still further object is to provide a low cost solution to the problem of desiring various height basketball goals, which is easily installed by the homeowner.

And still another object is to provide such an adjustable device which is easily used by any person, even a child, who desires to adjust the goal height.

These and other objects and advantages, and the manner in which they are achieved will be made apparent as the specification and claims proceed, taken in conjunction with the drawings, which illustrate the preferred embodiment.

SUMMARY OF THE INVENTION

In its general concept the present invention is a basketball backboard adjustment apparatus which is operable to vary the height of a basketball goal, including a mounting standard having a mounting means, which in other than the present assembly would normally mate with mounting means in a basketball backboard, and including a frame attached to one of the mounting means, a track mounted on the frame and extending vertically, a carraige mounted on the track, attachment means on the carriage engageable with the other mounting means, and a user controlled adjustment means interconnecting the frame and the carriage for moving the carriage along the track as desired by the user for raising or lowering the basketball goal.

DESCRIPTION OF THE PREFERRED EMBODIMENT

Figure 1:
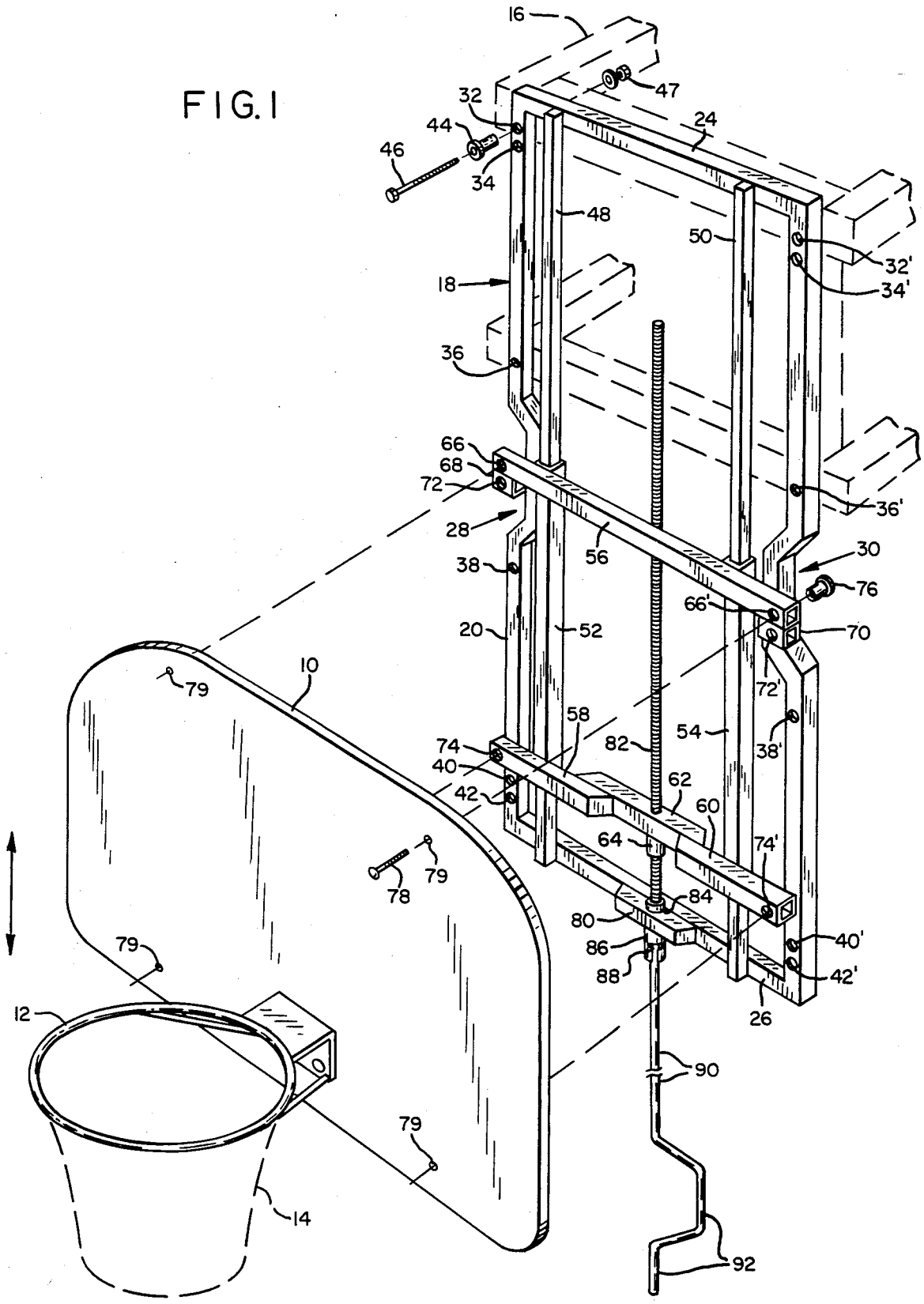
FIG. 1 is a top, perspective view of the basketball backboard adjuster of the present invention, shown with the mounting standard and the backboard and hoop.
Figure 2:
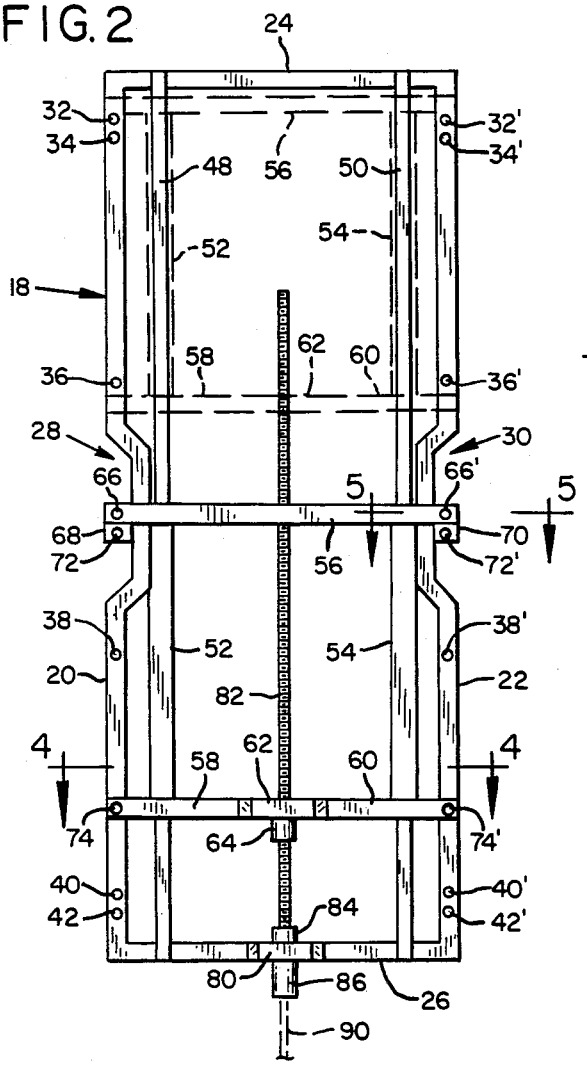
FIG. 2 is a front plan view of the basketball backboard adjuster of FIG. 1.

A common design of a basketball goal is illustrated in FIG. 1, having a backboard 10 which mounts a hoop 12 and net 14. In normal (non-adjustable) use, this type of goal is mounted upon a framework or mounting standard 16. The standard may be a freestanding pole, or the wall or roof of a building. In any case, some framework is provided, which provides a common or standard sized mounting bracket for the backboard.

The basketball backboard adjuster is disposed between the backboard and the standard, engaging the common set of mountings of each, one on one side and one on the other. The backboard adjuster includes a frame, generally denoted at 18, which is comprised of upstanding side tubes 20 and 22. Square, hollow members are suitable structually for most of the device, as apparent from the drawings. The side tubes are connected, top and bottom, by top tube 24 and bottom tube 26, respectively. Centrally, in each of the side members, is a recessed area, shown at 28 and 30. The purpose of this inwardly recessed area is to provide access to the mounting means of the carriage as will be discussed hereinafter.

The frame is configured to engage and be secured to a set of the mounting means in either the standard 16 or the backboard 10. There are various practical reasons and limitations which give reason for adopting one configuratiion or another. Suffice it to say that the mounting options are sufficiently flexible to accomodate any unique problems or situations that an installer might encounter. Mounting holes 32,32' and 36,36' provide for mounting to the standard as illustrated. However, some sets of equipment have mountings with narrower vertical spacings, so mounting holes 34,34' are provided. Now in those instances where it is desirable to mount the bottom of the frame, instead of the top, mounting holes 38,38', 40,40', and 42,42' are provided.

To mount the frame onto the mounting standard, an insert 44 is provided. It is cylindrical and extends through the hole in the tube. The insert has substantially the same length as the width of the tube, and includes a flange, larger than the hole. A bolt 46 extends through the coaxial hole in the insert, and through a hole 49 (FIG. 3) in standard 16. It is fastened by a nut 47. Thus the dual purpose of the insert is to allow some sideways alignment for various installations, and also to prevent the tube from being crushed by cinching the nut. Only one such assembly is shown, but of course there would be mountings at each of the four locations on the standard as usual.

A track is mounted on the frame and extends in a substantially vertical direction. Preferably, the track comprises two parallel rails 48 and 50. Note that the rails are mounted on the front of the frame.

Figure 5:
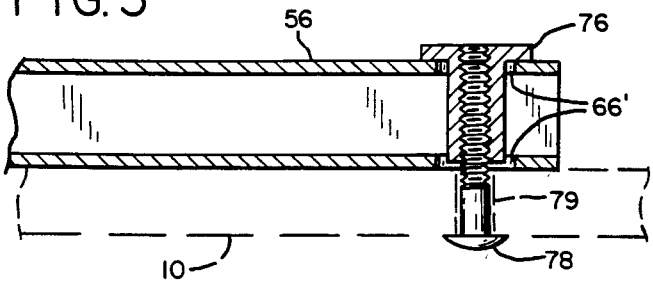
FIG. 5 is a section taken along the line 5—5 of FIG. 2.

A carriage is mounted on the track for substantially vertical movement with respect thereto. Preferably, the carriage includes two sliders 52 and 54 which are tubes which slide over rails 48 and 50, respectively. Further, the carriage includes a top cross bar 56, connecting between the sliders, and a bottom bar assembly, consisting of sections 58 and 60 engaging the sliders, and a central section 62 which is in the plane of the rails. The central section mounts a nut 64. The top bar of the carriage includes mounting holes 66,66'. Mounted on the top bar 56 are short flange sections 68 and 70, which include holes 72,72', for the same purpose as the multiple holes in the frame. Bottom section 58 has hole 74 therein, and section 60 has hole 74' therein. Note that the vertical spacing of the holes is the same as in the frame. So is the horizontal spacing. Of course the holes must mate with the mounting holes of the standard and the backboard, which have the same set of holes or mounting configuration. Insert 76 fits into the tubes of the carriage, in the same manner and for the same purpose as heretofore described with respect to insert 44. The arangement is better shown in FIG. 5. Note however, that insert 76 is threaded, and acts as a nut for bolt 78 which extends through mounting holes 79 in the backboard.

Figure 3:
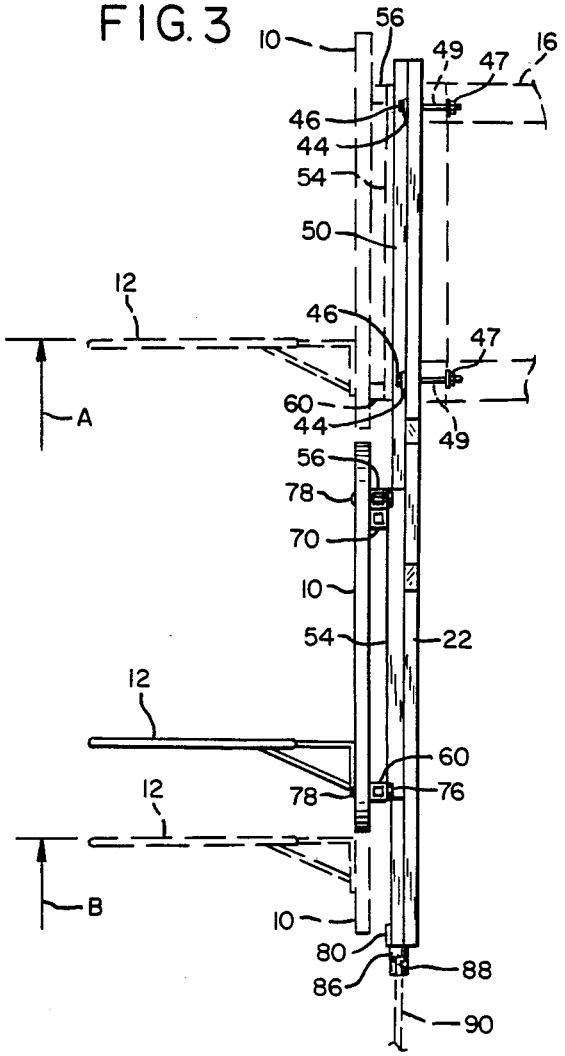
FIG. 3 is a side view of the basketball backboard adjuster of FIG. 1, showing in dashed lines the highest and lowest positions thereof.
Figure 4:
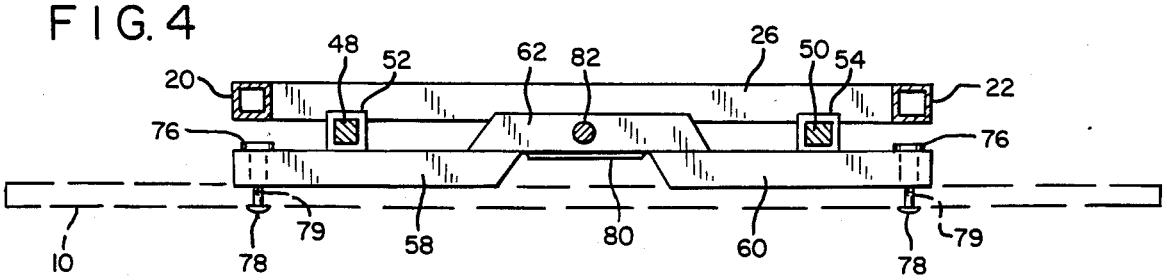
FIG. 4 is a section taken along the line 4—4 of FIG. 2.

Herein is the purpose for the inward recessed areas 28 and 30 of side bars 20 and 22. Because of the narrow distance between the frame and the carriage, the recessed area facilitates the mounting of the set of mounting means attached to the carriage. FIG. 3 shows that in the plane of the rails 48 and 50 the head of bolt 46 and the flange of insert 76 allow sufficient space just to slide past one another.

A flange 80 is mounted to bottom frame bar 26 and has a hole therethrough in which is journaled a screw 82. This provides a user controlled adjustment means interconnecting the frame and the carriage for moving the carriage along the track and positioning it as desired by the user. On the sides of flange 80 is mounted a retaining collar 84 and a coupler 86. The screw extends up through nut 64, and thereby sliding motion may be applied to the carriage. Note that the screw is also in the central plane, the plane of the rails. Coupler 86 has a T-shaped slot 88 therein, and a hollow core, which accepts a removable crankshaft 90, having a nub (not shown) on its end, which locks into the T-shaped slot. The crankshaft extends downwardly several feet, and has crank handles 92, which can be easily turned by any user.

FIG. 3 illustrates the range of adjustment between the upper dashed position, with the hoop at ten feet, denoted as position A, and the lower dashed position, having the hoop at eight feet, denoted as position B. Of course, any setting mid-range, as the user desires is completely acceptable.

The present device is easily installed, and easily operated. The hand crank may be left with the unit, if it is against a wall, or it may be removed for safety if desired.

The foregoing description is of the preferred embodiment, and obvious modifications may be made to the appatatus without departing from the spirit and scope thereof.

Having described my invention in its preferred embodiment, I claim:

1. A basketball backboard adjustment apparatus for varying the height of a basketball backboard and hoop, comprising in combination:

(a) a mounting standard having a set of mounting means;

(b) a basketball backboard having another set of mounting means configured to mate with the mounting means of the standard;

(c) a frame having generally vertically extending sides, each side including an access area at a point along the length thereof, and being configured to be attached to a set of the mounting means;

(d) a track mounted on the frame and extending substantially vertically in direction;

(e) a carriage mounted on the track for substantially vertical movement relative thereto in close proximity to the frame;

(f) attachment means mounted on the carriage and accessable through the access area of the frame and engageable with the other set of mounting means; and (g) user controlled adjustment means interconnecting the frame and the carriage for moving the carriage along the track and positioning it as desired by the user.

2. The apparatus of claim 1 wherein the access area is an inward recess in each side of the frame.

3. The apparatus of claim 1 wherein the track comprises two rails mounted on the frame, and wherein the carriage includes sliders engaging the rails for movement therealong.

4. The apparatus of claim 1 wherein the adjustment means comprises a rotatable screw journaled in the frame and engageable with a nut mounted on the carriage.

5. The apparatus of claim 4 wherein the screw is driven by a hand crank, and includes a coupler at the lower end of the screw so that the hand crank may be removed to be out of the way for playing basketball.

6. The apparatus of claim 1 wherein the frame and carriage have a plurality of mating configurations of mounting means for universal attachment of the height adjusting apparatus to variously designed backboard and mounting standard combinations.

7. The apparatus of claim 1 wherein the frame is attached to the mounting standard and the backboard is attached to the carriage.

8. The apparatus of claim 1 wherein the frame is attached to the backboard and the mounting standard is attached to the carriage.

9. The apparatus of claim 1 wherein the frame and carriage are made of square tube, having holes therethrough providing mounting means, and further comprising inserts extending through the holes, each insert being cylindrical and extending through the tube substantially the same length as the width of the tube, and having a flange abutting one side of the tube, and having a hole coaxially therethrough for receiving a bolt.

10. The apparatus of claim 9 wherein the hole through the insert is threaded, providing a nut.

11. The apparatus of claim 1 wherein the adjustment provides a variable height basketball hoop, while maintaining constant horizontal position.

12. The apparatus of claim 1 wherein the hoop height is adjustable from eight to ten feet.

13. For use with a basketball backboard and a mounting standard therefor, wherein one set of mounting means in the backboard mate with another set of mounting means in the standard, a basketball backboard and hoop height adjusting apparatus comprising:

(a) a frame having generally vertically extending sides, each side including an access area at a point along the length thereof, and being configured to be attached to a set of the mounting means;

(b) a track mounted on the frame and extending substantially vertically in direction;

(c) a carriage mounted on the track for substantially vertical movement relative thereto in close proximity to the frame;

(d) attachment means mounted on the carriage and accessable through the access area of the frame and engageable with the other set of mounting means; and (e) user controlled adjustment means interconnecting the frame and the carriage for moving the carriage along the track and positioning it as desired by the user.

14. The apparatus of claim 13 wherein the frame and carriage each provide a plurality of mating configurations of mounting means for universal attachment of the height adjusting apparatus to variously designed backboard and mounting standard configurations.

15. The apparatus of claim 13 wherein the frame is attached to the mounting standard and the backboard is attached to the carriage.

16. The apparatus of claim 13 wherein the frame is attached to the backboard and the mounting standard is attached to the carriage.

* * * * *